US007074006B1

(12) United States Patent
Hathaway et al.

(10) Patent No.: US 7,074,006 B1
(45) Date of Patent: Jul. 11, 2006

(54) ENDWALL TREATMENT AND METHOD FOR GAS TURBINE

(75) Inventors: Michael D. Hathaway, Avon Lake, OH (US); Anthony J. Strazisar, Chester, OH (US); Kenneth L. Suder, Wadsworth, OH (US)

(73) Assignee: The United States of America as represented by the Administrator of National Aeronautics and Space Administration, Washington, DC (US)

( * ) Notice: Subject to any disclaimer, the term of this patent is extended or adjusted under 35 U.S.C. 154(b) by 272 days.

(21) Appl. No.: 10/267,884

(22) Filed: Oct. 8, 2002

(51) Int. Cl.
*F01D 1/12* (2006.01)

(52) U.S. Cl. ..... 415/1; 415/58.5; 415/58.7

(58) Field of Classification Search ..... 415/1, 415/116–117, 202, 144, 914, 220, 57.1–57.7, 415/58.1–58.7, 173.1–173.4
See application file for complete search history.

(56) References Cited

U.S. PATENT DOCUMENTS

| | | | | |
|---|---|---|---|---|
| 5,211,533 | A | 5/1993 | Walker et al. | |
| 5,282,718 | A * | 2/1994 | Koff et al. | 415/57.3 |
| 5,308,225 | A * | 5/1994 | Koff et al. | 415/57.3 |
| 5,431,533 | A | 7/1995 | Hobbs | |
| 5,452,573 | A | 9/1995 | Glickstein et al. | |
| 5,458,457 | A * | 10/1995 | Goto et al. | 415/115 |
| 5,474,417 | A * | 12/1995 | Privett et al. | 415/58.5 |
| 5,520,508 | A | 5/1996 | Khalid | |
| 5,586,859 | A * | 12/1996 | Nolcheff | 415/58.5 |
| 5,607,284 | A * | 3/1997 | Byrne et al. | 415/58.5 |
| 5,826,424 | A | 10/1998 | Klees | |
| 5,984,625 | A | 11/1999 | Murray et al. | |
| 6,050,080 | A | 4/2000 | Horner | |
| 6,077,035 | A | 6/2000 | Walters et al. | |
| 6,155,777 | A | 12/2000 | Aschenbruck et al. | |
| 6,162,011 | A | 12/2000 | Gerhardt et al. | |
| 6,183,195 | B1 | 2/2001 | Tremaine | |
| 6,195,983 | B1 | 3/2001 | Wadia et al. | |
| 6,203,269 | B1 | 3/2001 | Lorber et al. | |
| 6,220,012 | B1 | 4/2001 | Hauser et al. | |
| 6,231,301 | B1 | 5/2001 | Barnett et al. | |
| 6,244,817 | B1 * | 6/2001 | Ngo | 415/119 |
| 6,264,425 | B1 | 7/2001 | Keller | |
| 6,267,552 | B1 | 7/2001 | Weigand | |
| 6,273,682 | B1 | 8/2001 | Lee | |
| 6,290,458 | B1 | 9/2001 | Irie et al. | |
| 6,312,221 | B1 | 11/2001 | Yetka et al. | |
| 6,331,096 | B1 | 12/2001 | Burdgick et al. | |
| 6,334,753 | B1 | 1/2002 | Tillman et al. | |
| 6,340,284 | B1 | 1/2002 | Beeck et al. | |
| 6,357,221 | B1 | 3/2002 | Schroeder et al. | |
| 6,364,602 | B1 | 4/2002 | Andrew et al. | |
| 6,742,983 | B1 * | 6/2004 | Schmuecker | 415/58.5 |

* cited by examiner

*Primary Examiner*—Edward K. Look
*Assistant Examiner*—Richard A. Edgar
(74) *Attorney, Agent, or Firm*—Kent N. Stone; Rodney S Koglund; Shannon McCue

(57) ABSTRACT

An endwall treatment for a gas turbine engine having at least one rotor blade extending from a rotatable hub and a casing circumferentially surrounding the rotor and the hub, the endwall treatment including, an inlet formed in an endwall of the gas turbine engine adapted to ingest fluid from a region of a higher-pressure fluid, an outlet formed in the endwall and located in a region of lower pressure than the inlet, wherein the inlet and the outlet are in a fluid communication with each other, the outlet being adapted to inject the fluid from the inlet in the region of lower pressure, and wherein the outlet is at least partially circumferentially offset relative to the inlet.

41 Claims, 13 Drawing Sheets a) ADIABATIC EFFICIENCY b) TOTAL PRESSURE RATIO a) ADIABATIC EFFICIENCY b) TOTAL PRESSURE RATIO a) ADIABATIC EFFICIENCY b) TOTAL PRESSURE RATIO a) ADIABATIC EFFICIENCY b) TOTAL PRESSURE RATIO a) ADIABATIC EFFICIENCY b) TOTAL PRESSURE RATIO

ENDWALL TREATMENT AND METHOD FOR GAS TURBINE

ORIGIN OF THE INVENTION

The invention described herein was made by employees of the United States Government and may be manufactured and used by or for the Government for Government purposes without the payment of any royalties thereon or therefore.

TECHNICAL FIELD

The present invention generally relates to gas turbines, and, more particularly to gas turbines used for aircraft propulsion and in power generation. Most particularly, the present invention relates to improving fan/compressor stability in such turbines.

BACKGROUND OF THE INVENTION

Gas turbines are used in a variety of applications including aircraft power generation. At the core of such a turbine are a number of stages including a compressor that is used to increase the pressure of the incoming free stream flow. The compressor typically includes a rotor that includes a rotating hub with a number of radially extending blades. The rotor is typically found within a housing or shroud referred to as a casing, wherein the blade tips extend as close as possible to the casing "endwall". These turbines have evolved to provide a reliable power source for aircraft, but also carry inherent limitations. One pertinent limitation is the phenomenon known as stall.

As is well known by gas turbine practitioners, stall or surge is a phenomenon that is characteristic of all types of axial or centrifugal compressors that limits their pressure rise capability. Those involved in compressor technology pay great heed to the surge characteristics of the compressors to assure proper compromise between performance and safe operation. During compressor operation, stall occurs when the stream wise momentum imparted to the air by the blades is insufficient to overcome the pressure rise across the compressor stage resulting in a reduction in airflow through a portion of the compressor stage. The flow leakage that occurs across the clearance gap between the compressor rotor blade tip and stationary casing endwall is one well known mechanism for reducing the total stream wise momentum through the blade passage, thus reducing the blade pressure rise capability and moving the compressor closer towards the stall condition. If no corrective action is taken, the compressor stall may propagate through several compressor stages, starving the gas turbine of sufficient air to maintain engine speed that decreases the turbines ability to create power, further reducing the output of the engine. Further, the instability created by stall may generate forces that can potentially damage the engine. If stall spreads to encompass all stages within the compressor, the global flow through the engine may actually be reversed resulting in the phenomena known as surge that exacerbates the losses, reduces engine power and increases the potential for catastrophic damage. To avoid stall, operating limits may be placed on the engine to define a safe operating range, where stall is unlikely. This operating range between the safe operating limit and stall is often referred to as the "stall margin." As in many systems, greater efficiency is achieved at higher operating conditions, and, thus, to that extent, engine efficiency is sacrificed to obtain safe operating conditions. As will be appreciated, to further avoid stall and to improve engine performance, it is desirable to expand the stall margin for a given engine. The current trend towards increased pressure rise per stage and increased blade aerodynamic loading, however, tends to reduce the stable operating range of turbine compressors. To maintain adequate stall margin, the compressor must either operate in an inefficient manner i.e. further from the optimum efficiency point, or methods must be devised to extend the stable operating range of the compressor. Over the last thirty years various forms of endwall treatments have been employed for enhancing compressors stall range, generally at the expense of compressor efficiency.

The current state of the art in endwall treatment and designs utilizes the static pressure rise created at the compressor to recirculate high-pressure fluid to energize low momentum fluid along the casing or hub endwall, hereinafter referred to as endwall blockage. To energize the low momentum fluid, high-pressure fluid is channeled from the rear to the front of a compressor rotor through a path contained within the casing surrounding the compressor. The high-pressure fluid is then reinjected upstream of the rotor to energize the low momentum fluid at the casing or hub.

For example, one endwall treatment known in the industry incorporates a passage having an outlet port disposed over the tip of the blade and near the leading edge of the blade. The outlet port is disposed at an acute angle relative to the plane of the blade tip. An inlet port is located downstream of the outlet port near the trailing edge of the blade. In this design, the inlet port is located over the tip of the blade and connected to the outlet port by a passage that extends initially radially outward at an acute angle relative to the casing and then curves to form an elbow at its radial extremity and continues in angular fashion radially inward toward the outlet port. To counteract the high swirl component of air taken from the trailing edge of the blade tip, an anti-swirl element is located within the casing to de-swirl the air ingested at the inlet. The anti-swirl elements include reverse swirl vanes disposed at an angle relative to the main airflow and adapted to reorient the ingested air in a flow path parallel to the main flow. In this design it was observed that such a treatment could recover the energy of the low momentum flow leaving the rotor tip and return it to the main flow in an essentially axial direction. To achieve this, the dimension of the inlet, outlet, and passageway were designed to recirculate 12% of the total airflow in the main flow.

In another design in the industry, a similar passageway is used to remove low momentum fluid from the main flow of an aircraft engine. In this design, like the previously mentioned example, the flow is removed downstream of the leading edge of the blade's tip and returned at a point over the blade tip. In contrast to the previously discussed design, the inlet and outlet port angles extend at an oblique angle to the plane of the blade tip. A critical feature of this design is that the upper limit of the air removed is 8 percent. In a later patent, U.S. Pat. No. 5,431,533, after realizing that the recirculation of low momentum fluid still did not provide desired maintenance of engine efficiency, operation of the recirculating passage discussed in the previous example was limited to periods when incidence of stall was more likely. At all other times, the recirculation passages were blocked off by inflatable membranes located near the inlet and outlet sides of the passage.

Recognizing the difficulty of individually machining vanes capable of recirculating low momentum fluid, as described, within the casing, a more recent design known within the industry provides an annular plenum formed by the attachment of an insert to the casing's inner wall. The insert is provided with a recessed portion that is located on the radial outward surface of the insert that cooperates with the inner surface of the casing to define an annular plenum. Inlet and outlet ports extend through the insert to communicate with the plenum. These ports, as with previously described ports, extend at an oblique angle relative to the tip of the blade and are located above the blade tip.

This advancement of using a recirculated endwall treatment has provided the greatest stall range capability with the least decrement to compressor efficiency of previous endwall treatment concepts, but such treatment still results in an appreciable decrement in compressor efficiency.

SUMMARY OF THE INVENTION

It is an aspect of the present invention to provide a self-recirculating endwall treatment that improves the operating range of the compressors without the attendant loss of efficiency suffered by existing treatment designs.

It is another aspect of the present invention to provide a method of controlling the stall limiting fluid physics with an endwall treatment.

In view of at least one of these aspects, the present invention generally provides an endwall treatment for gas turbine engine having at least one rotor blade extending from a rotatable hub and a casing circumferentially surrounding the rotor and the hub, the endwall treatment including: an inlet formed in an endwall of the gas turbine engine adapted to ingest fluid from a region of a higher pressure fluid, an outlet formed in the endwall and located in a region of lower pressure than the inlet, wherein the inlet and the outlet are in a fluid communication with each other, the outlet being adapted to inject the fluid from the inlet in the region of lower pressure, and wherein the outlet is at least partially circumferentially offset relative to the inlet.

The present invention further provides an endwall treatment for treating a blockage within a gas turbine having at least one rotor blade extending from a rotatable hub, the hub being located in a free stream flow wherein a blockage is located in the free stream flow adjacent the rotor blade, the endwall treatment including: an inlet adapted to bleed higher pressure fluid from the free stream, an outlet fluidly connected to the inlet, wherein the outlet is adapted to deliver the higher pressure fluid from the inlet to energize the free stream flow near a source of the blockage.

The present invention further provides a method of treating a blockage within a free stream flow through a gas turbine, the gas turbine having a rotor rotatable about an axis and having at least one blade, the method including: bleeding a portion of the free stream flow through an inlet and recirculating the portion through an outlet located upstream of the inlet within the free stream flow to energize the blockage, and offsetting the outlet and inlet in a circumferential direction to reduce the likelihood of reingestion of the portion of the free stream flow by the inlet.

The present invention further provides an endwall treatment used to relieve a blockage near a rotor in a gas turbine, the rotor being rotatable about an axis and having at least one blade, the blade having a chord length, the endwall treatment including an inlet adapted to bleed fluid from the blockage, wherein the inlet is axially located relative to the blade in a position from about −20% to about 115% of the core length.

The present invention further provides an endwall treatment for relieving a blockage near a rotor, the rotor being rotatable about an axis and having at least one blade, the blade having a chord length in an axial direction, the endwall treatment including: an outlet adapted to inject fluid to alleviate the blockage, wherein said outlet is located at an axial position of about −15% to about 40% of the chord length.

The present invention still further provides an endwall treatment method for a gas turbine engine including injecting fluid in a free stream flow to alleviate a blockage within the free stream flow, wherein the injection of the fluid occurs near the source of the blockage.

The present invention still further provides an endwall treatment for treating a blockage in a gas turbine including: a plurality of inlets each and outlets each respectively fluidly connected to one another by a passage, wherein the outlets and inlets are spaced from each other in a circumferential direction to discretely inject fluid to alleviate the blockage.

DETAILED DESCRIPTION OF THE INVENTION

Figure 3:
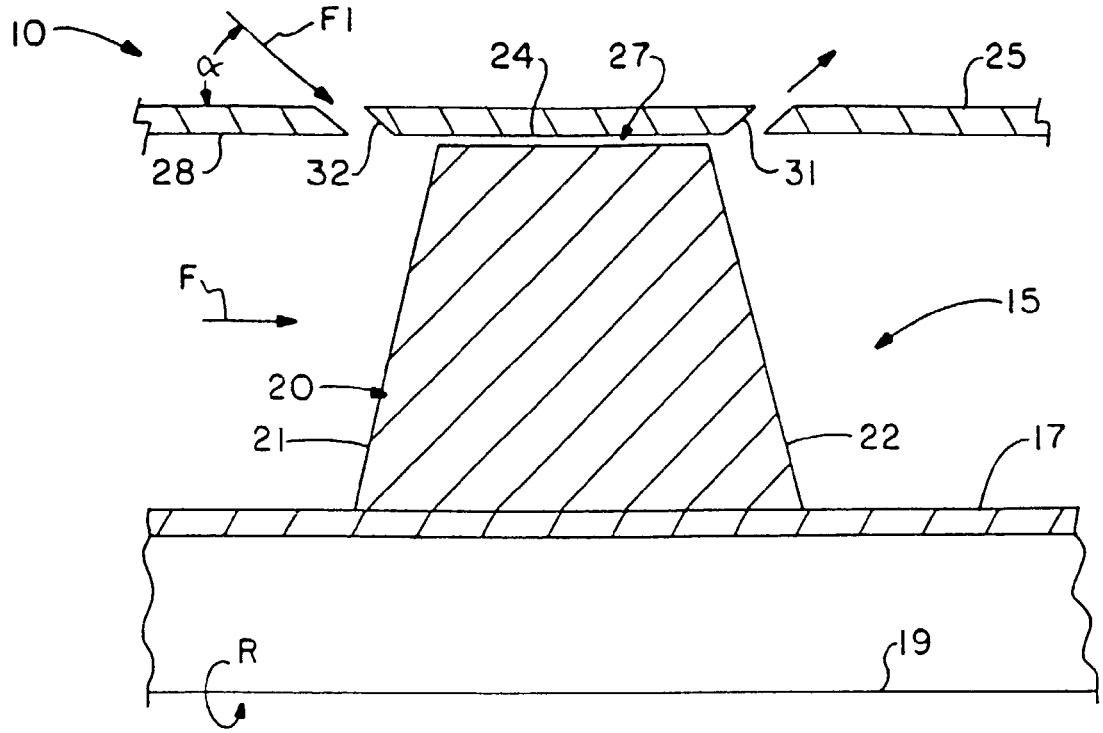
FIG. 3 is a side elevational view, partially in section, depicting a endwall treatment according to the concepts of the present invention showing a rotor having a hub with a radially extending blade surrounded by a casing having an inlet port located downstream of or within the rotor blade and an outlet port located upstream of or within the rotor blade.

A self-recirculating endwall treatment according to the concepts of the present invention is generally indicated by the numeral 10 in the accompanying drawings. The term "endwall treatment" will be used herein to refer to a method and apparatus used to recirculate fluid in a gas turbine in the accompanying drawings. Gas turbine generally includes a rotor assembly, generally indicated by the numeral 15 that includes a hub 17 rotatable about an axis 19. Hub 17 is rotatable about the axis 19 and includes one or more radially outward extending blades 20. One such blade 20 is depicted in FIG. 3, and generally includes a leading edge 21 and a trailing edge 22 referred to by their relative location within the main flow, indicated by the arrow F in FIG. 3. The blade 20 further includes a tip 24 at its radial outward extremity. As shown, the tip 24 is generally located in close proximity to a shroud or casing, generally indicated by the numeral 25 that houses the rotor 15. A clearance 27 is defined between the casing 25 and blade tip 24.

Figure 5:
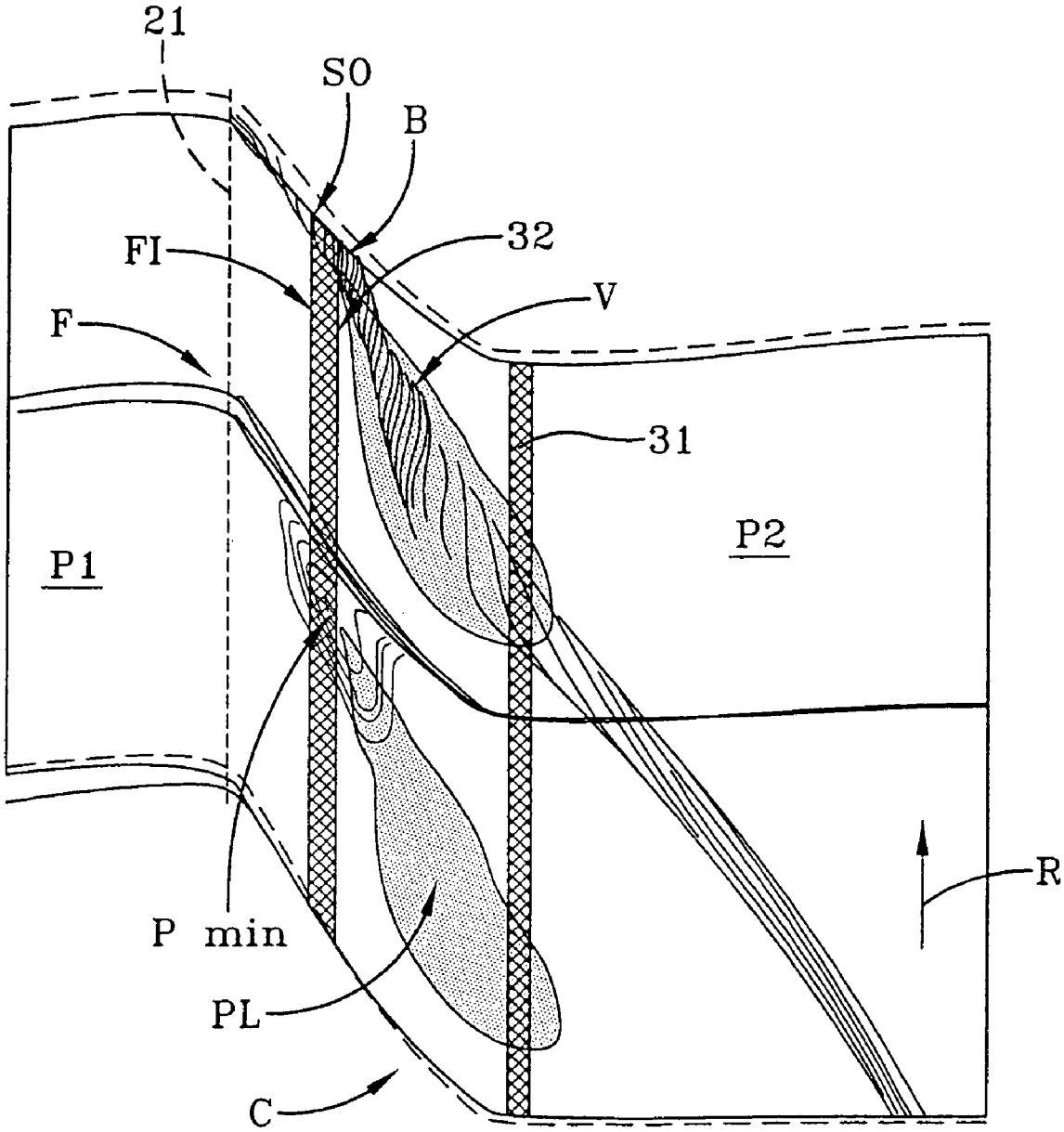
FIG. 5 is a representative graph depicting the relative total pressure surface contours at the tip section of a low speed fan rotor identifying blockage producing mechanisms.

Free stream flow F is shown traveling in a generally axial direction relative to the casing 25. At the compressor stage C, the free stream flow F is pressurized by the blades 20. In this way, the free stream flow F upstream of the blades 20 is at a first pressure P1 and the free stream flow F downstream of the blades is at a second pressure P2 greater than the first pressure P1. Additional stages may be provided to provide additional increases in the pressure of the free stream flow F. For simplicity, the compressor stage C will be used as an example and is not limiting in terms of the application of the present invention. Ideally, the free stream flow F would be compressed without loss, but various blockage mechanisms affect the flow through the compressor C. The term "blockage mechanism" or "blockage" will be used to collectively refer to a number of fluid phenomenon that may affect engine performance or contribute to the inducement of stall including adverse pressure gradients, such as shock, and low momentum fluid mechanisms, such as, leakage vortices, endwall boundary layers, blade boundary layers, secondary flows, and tip clearance flows, among others, and will be generally indicated by the letter B in the accompanying drawings. It will be understood that, due to the viscous nature of the free stream flow F, such blockage may occur at any of the surfaces within the flow F and, for simplicity, all of such surfaces will be collectively referred to as an endwall, for purposes of this description. One example of blockage B is the accumulation of low momentum fluid within the clearance 27 (FIG. 3) between the tip 24 and the casing 25 of compressor C. The low momentum fluid in this region can be caused by a combination of blockage mechanisms including a leakage vortex V near the leading edge 21 of the blade 20, as is schematically shown in FIG. 5. Due the swirl component of the vortex, the fluid surrounding the vortex has a low momentum in the direction of the free stream flow F.

To energize the low momentum fluid, the endwall treatment 10 injects high velocity fluid at FI to energize the low momentum fluid in clearance 27. To that end, endwall treatment 10 includes an inlet port 31 generally located in an area of greater pressure to create a reverse flow through the treatment 10. In the example shown, the inlet port 31 is located downstream of or within the compressor C near the trailing edge side of tip 24, or wherever sufficiently higher-pressure fluid is available. As previously described the compressor C increases the pressure of the free stream flow F and thus provides a convenient source of pressurized fluid. It will be appreciated that other sources of pressurized fluid are present within an aircraft engine including fluid near the stator (not shown).

An outlet or injection port 32 is connected to the inlet 31 by a passage 35 (FIG. 13), which may contain anti-swirl assemblies (not shown) to de-swirl incoming fluid from the inlet 31 before injection of the fluid at outlet port 32. The outlet port 32 is adapted to inject fluid at or near the source SO (FIG. 5) of the blockage B. It will be appreciated that the source SO may not be constant and the outlet port 32 may be adapted to inject fluid at multiple points. Alternatively, multiple outlet ports 32 may be provided to cope with changes in the origin of a particular blockage. For instance, in the leakage vortex example, the source SO of the blockage is generally located near the point of minimum static pressure on the suction surface 23 (FIG. 4) of the blade, as shown in FIG. 5. The source SO may also coincide with the point of greatest pressure change. Thus, as shown in FIG. 5, the point of minimum pressure P min lies within the plane defined by the outlet 32. With further reference to FIG. 5, the injection port 32 may be located just upstream of the blockage B, which in the example shown is identified by the region of low relative total pressure, generally indicated as PL in the drawings, to be energized.

The angle of injection θ should be such that the injected fluid indicated by the arrow FI, is aligned with the rotor blade suction surface 23 in the frame of reference relative to the rotor 15 to account for the injected flow's change from an absolute reference frame to a moving reference frame within the path of the rotor 15. The mass flow $M=M_b$ of the injected flow re-circulated through the endwall treatment 10 should initially be sized commensurate with the mass flow deficit in the rotor blade tip clearance gap 27, in the vicinity of the blockage mechanism, B, as defined by Equation 1 where t denotes rotor blade tip c denotes casing.

$$m_1=m_b=\rho_t V_{x,t}\pi(r_c^2-r_t^2)-2\pi_{r_t}^{r}\int\rho V_x r dr \qquad \text{Equation 1}$$

In other words, only a proportion of the free stream flow F necessary to create an increase in the velocity V of the low momentum fluid, along the desired flow path, an extent substantially equal to the velocity deficit caused by the blockage B should be removed from the high-pressure source. This ensures that a minimal amount of pressurized fluid P2 is removed. As will be appreciated, since the compressor C must do work, to create the pressurized fluid P2 in the given example, the removal of pressurized fluid P2 directly contributes to the compressor's efficiency. Thus, by removing the lowest amount of fluid necessary to compensate for the blockage B ensures the smallest decrement in compressor efficiency.

The velocity of the injected fluid, $V_i$ in the frame of reference of the casing 25, will be that dictated by the pressure ratio between the inlet and injection ports 31, 32 and the pressure losses associated with the endwall treatment 10, as shown graphically in FIG. 3. The velocity $V_i$ of the injected fluid may be calculated according Equation 2, where i=injection port 32, b=bleed port, 31.

$$V_i = \sqrt{\frac{2\gamma Rg}{\gamma - 1} T_{t,1}[1 - (P_1 / P_{t,1})^{(\gamma-1)/\gamma}]}$$

Where $P_{t,i}=P_b=(1-\omega)\frac{1}{2}\gamma P_b M_{abs,b}^2$ and $T_{t,i}=T_{t,b}$ Equation 2:

$V_{n,i}=V_i \sin(\alpha_i)$ Equation 3:

To the extent that the available pressure rise across the rotor 15 and the absolute angle of injection make it possible, it is desirable to attempt to achieve a relative velocity for the injected fluid FI commensurate with the velocity of the free stream flow F away from the influence of the tip clearance flow. With the initially established mass flow rate m, through the endwall treatment 10, the prescribed injection angle $\alpha_i$, and the pressure ratio set by the location of the inlet and injection ports 31, 32, the area Ai of the injection port 32 is established by Equation 4.

$A_i=m_i/(\rho_i V_{n,i})$ Equation 4

The inlet port area $A_i$ is sized to accommodate the injection mass flow rate m, and to ensure that the injected flow FI will not choke at the inlet port 31.

The injection port 32 may be located near the blade leading edge 21 to effect control over the leading edge vortex and tip section loading with the expectation that injection of the fluid FI at this point would beneficially impact the extent of low relative total pressure leaking across the blade tip gap 27.

Figure 12:
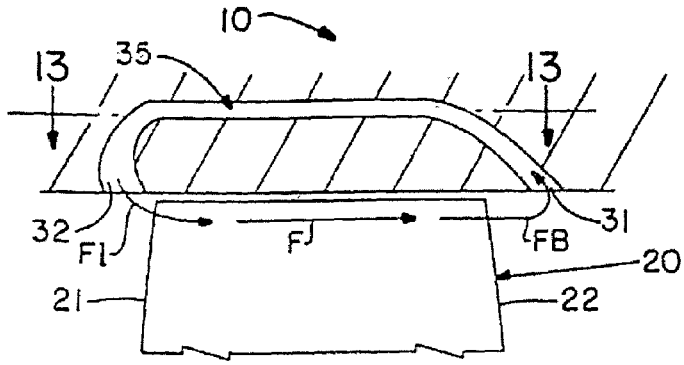
FIG. 12 is a schematic side elevational view with a casing sectioned to show details of the recirculated flow over a rotor blade according to the concept of the present invention.

The inlet port 31 may be located near any source of high-pressure fluid, for example, adjacent the trailing edge 22 of blade 20. The fluid bled off at the inlet port 31 may then be de-swirled as necessary and accelerated through a convergent passage 35 for injection into the blade passage 28. Convergence of the passage 35 may occur in any direction. When creating a circumferential offset 45 between the inlet 31 and outlet 32, as described more completely below, it is convenient to converge the passage 35 in the circumferential direction. For example in FIG. 12, a first passage wall 37 extends inwardly from a first edge 38 of the inlet 31 and toward the first edge 39 of the outlet 32. In the example shown first wall 37 extends in a generally linear fashion toward outlet 32 with a positive absolute slope until reaching an axial plane of the first edge 39 of the outlet 32, where its slope falls to 0. The remainder of wall 37 extends axially to the first edge 39 of the outlet 32. A second wall 41 of the passage 35 may extend generally axially from a second edge 42 of inlet 31 to a second edge 43 of outlet 32. An arcuate portion 44 may be provided adjacent inlet 31 to provide a smooth transition for the incoming bleed flow FB.

As previously described, injection may occur at discrete injection ports 32 located near the leading edge 21 of the blade 20, or where deemed most beneficial to overall performance. In the example shown, injection port 32 is located upstream of the leading edge 21 of rotor blade 20. Multiple injection ports 32 may be used and circumferentially spaced relative to corresponding inlet ports 31 to reduce the likelihood of reingestion of the injected fluid FI into the inlet ports 31. This alleviates the tendency found in typical self-recirculating endwall treatments to produce excessively high temperatures along the casing 25 and in the endwall treatment flow path due to reworking continually recirculated fluid. Further, since the reingested fluid is repressurized with each circuit through the treatment, the re-ingestion of the injected fluid found in prior art designs produces an effective loss. Offsetting the inlet and outlet ports prevents re-ingestion of the fluid allowing it to be pressurized and pass through the rotor 15 avoiding the effective loss described above.

Due to the increased static pressure of the bleed fluid FB compared to the injection fluid FI in the frame of reference of the rotor 15, the endwall treatment 10 increases the relative total pressure of the fluid in the endwall treatment flow path. The injected fluid FI may be reintroduced into the free stream flow F within blade passage 28 such that the injected fluid velocity V is at an incidence aligned with the relative yaw angle, in the rotor relative frame of reference, (β) of the rotor suction surface 23, and re-energizes the low momentum fluid along the casing 25 and within the blade clearance gap 27. The amount of recirculated fluid is commensurate with the displacement thickness across the blade clearance gap 27 relative to the free stream velocity (in the blade row frame of reference) away from the blade clearance gap 27. As will be understood, injected flow FI enters at an absolute yaw angle θ to account for change from the absolute referenced frame to the rotor relative frame F reference. In general, it may be desirable to introduce sufficient injected fluid FI with optimal incidence at high relative velocity to energize the low momentum fluid.

While a single endwall treatment 10 has been described, plural endwall treatments may be employed on a single gas turbine. In the prior art, the entire circumference of the casing is treated. The endwall treatment 10 of the present invention may be discretely implemented. The term "discrete", as used in the context of the circumferential coverage of casing 25 shall refer to less than 100% of the circumference being treated or a non-continuous implementation of endwall treatment 10. For example, in FIG. 13, first and second endwall treatments 10 and 10' are non-continuous being separated by a space S resulting in less than complete coverage of the casing circumference. It will be appreciated that plural treatments 10 may be spaced about the circumference in varying relation to each other using relatively few treatments 10 in comparison to the prior art. It has been found that implementing the endwall treatment 10 over less than 100% of the circumference improves the efficiency of the system.

Figure 13:
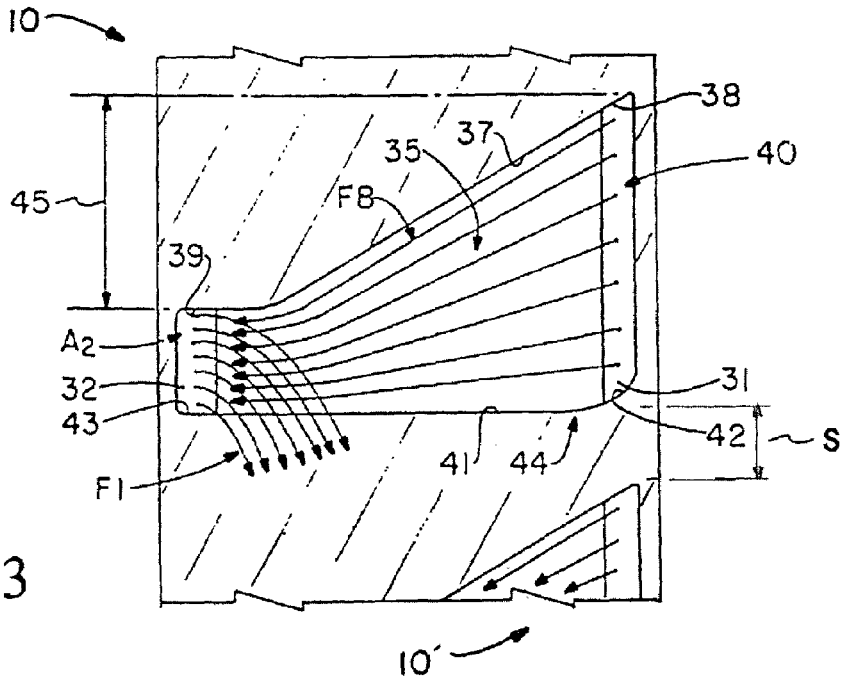
FIG. 13 is a partially schematic top elevational view of the endwall treatment depicted in FIG. 12.
Figure 14:
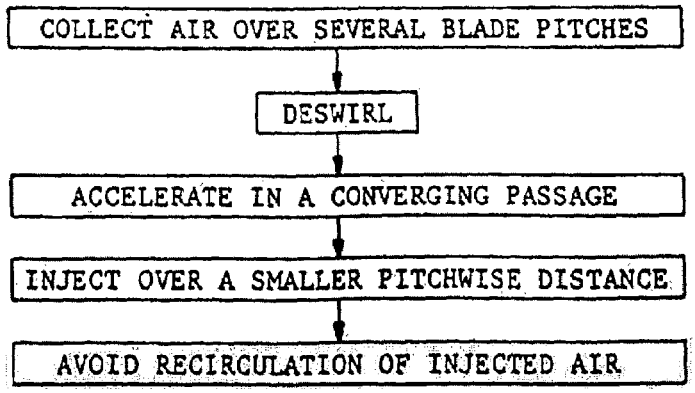
FIG. 14 is a flow diagram showing a method of increasing stall margin using an endwall treatment according to the present invention.
Figure 15:
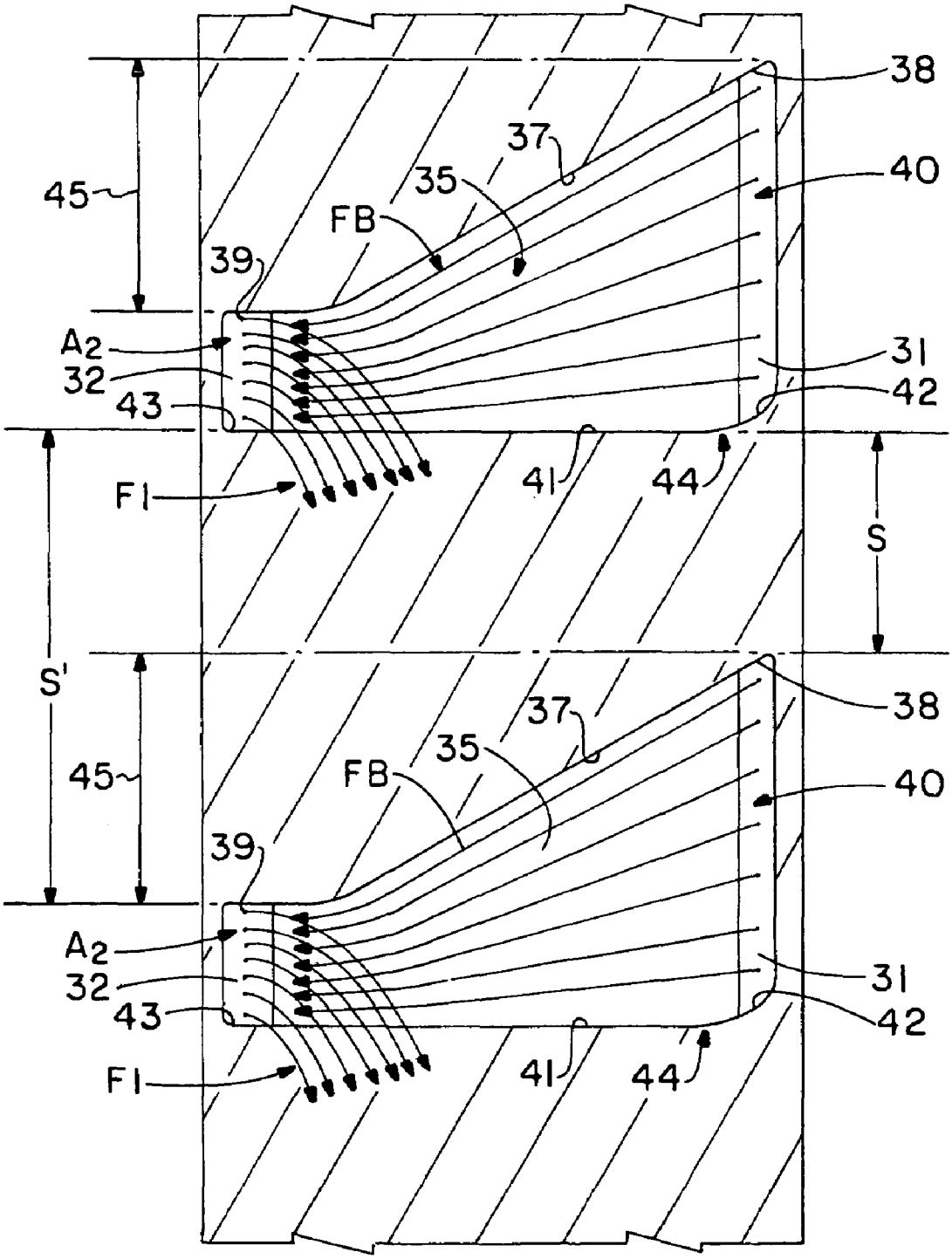
FIG. 15 is a partially schematic elevational view similar to FIG. 13 depicting a pair of endwall treatments.
Figure 16:
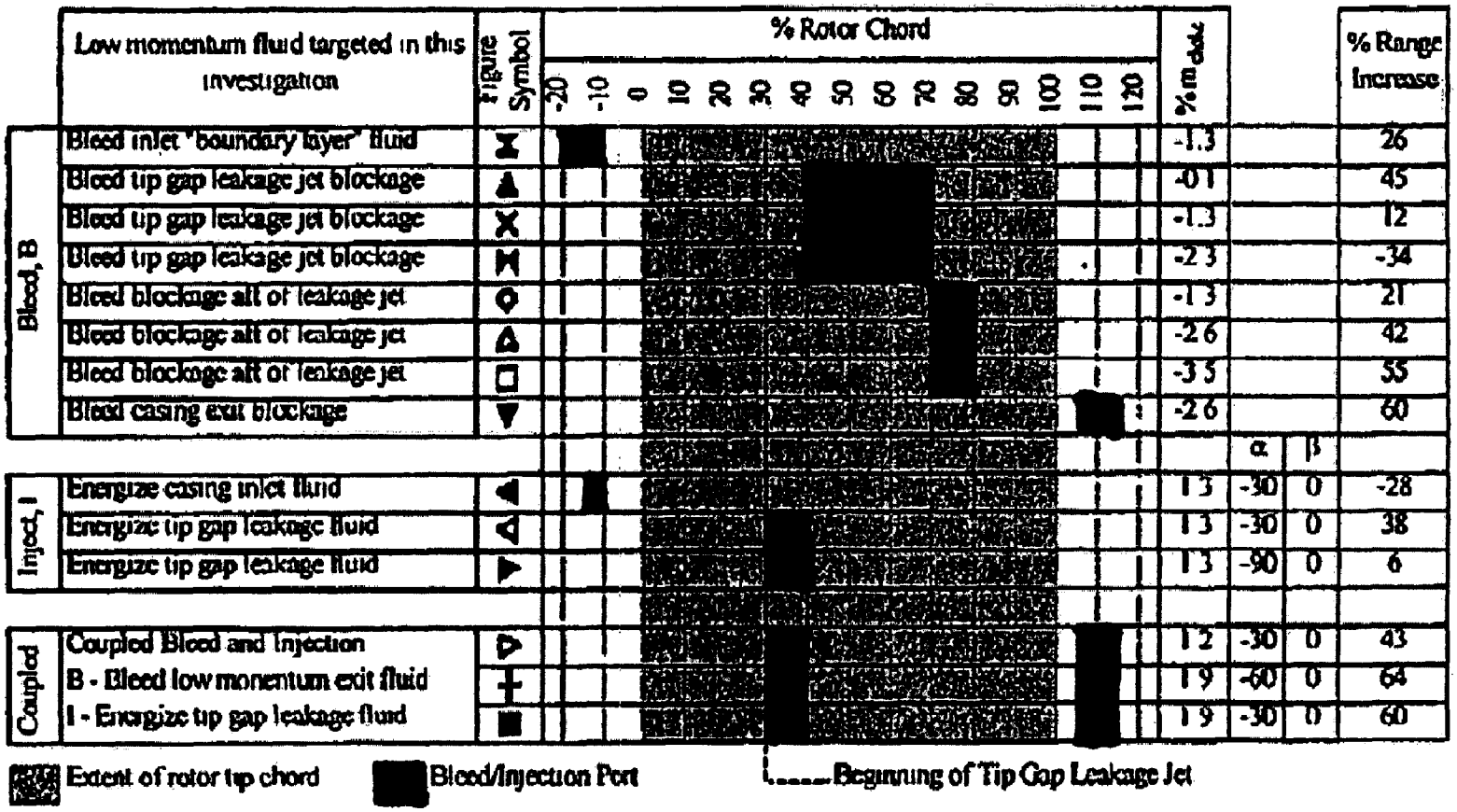
FIG. 16 is a table showing a number of positions from which a fluid was bled in terms of a percentage of a chord length.

One example arrangement of the inlet and injection ports 31, 32 is depicted in FIG. 13. There, it may be seen that the inlet port 31 is of a greater circumferential dimension than injection port 32 in this way at least a portion, generally indicated at 40, of inlet port 31 extends beyond the plane of injection port 32 creating an offset 45 in the circumferential sense. As discussed previously, the offset 45 between the inlet and injection ports 31, 32 avoids re-ingestion of the injected air FI at the inlet 31. As best shown in FIG. 13, the injected flow FI is directed circumferentially away from the inlet port 31 by the momentum of the rotor 15, such that, the injected flow FI is not reingested at the inlet port 31.

In order to demonstrate practice of the invention, a study was performed in the course of testing the present invention. This study is provided only as an example and should not be read to limit the invention in any way, the present invention being defined by the scope of the claims.

A parametric study of various casing bleed and injection configurations was performed using the Average Passage code (APNASA) developed by Adamczyk. APNASA is a 3D time-averaged Navier-Stokes code developed for multi-stage compressor analysis. For these simulations a CMOTT k-e turbulence model was used. The simulations were of an isolated blade row using an axisymmetric mass flow boundary condition to simulate casing bleed and injection. The upstream boundary condition was prescribed at standard day inlet conditions with 5% boundary layer thickness on both endwalls. The downstream hub static pressure was set and incrementally adjusted in stepwise fashion to develop a prediction of the rotor speed line for various casing bleed/injection configuration. Convergence was deemed to be achieved when the mass flow rate, pressure ratio, efficiency, and number of separated points remained essentially constant with increasing iteration count.

As stall was approached the number of separated points in the flow field and other flow field parameters varied as a function of iteration count. However, the simulation approaches a limit cycle in which the peak-to-peak amplitude of the flow field differences does not grow with increasing iteration count. Away from stall, the convergence was well behaved with little or no variation with increasing iterations. The predicted stall point was judged to be the last stable condition prior to incurring, for a fixed hub static pressure, a continual drop in mass flow rate and pressure ratio with increasing iteration count.

The ability of the APNASA code to predict stall for an isolated transonic rotor has been demonstrated. Though the question still remains as to whether a steady axisymmetric code can adequately predict stall for any rotor it was deemed reasonable to expect that if the code predicts an improvement in stall range that such would be realized experimentally though perhaps to a different degree.

A low noise fan rotor was selected for the parametric investigation of the impact of casing endwall bleed and injection on rotor performance. The fan rotor had 18 blades, an inlet tip radius of 28.13 cm, a hub-tip radius ratio of 0.426, and an aspect ratio of 2.75, a tip solidity of 0.6, and an axial chord of 5.87 cm at the tip and 5.82 cm at the hub. The rotor tip clearance gap was simulated at 6.8% of tip axial chord (3 times the design clearance) to assure that the tip flow field would control the stall point. The simulation was performed at 8750 rpm. The choking mass flow rate at that speed is 38.955 kg/sec based on simulations. The mesh size used for the parametric investigation of the low noise fan is 162 axial−51 radial×55 tangential nodes with 10 cells in the rotor tip clearance gap.

The parametric investigation was guided by reported observations that endwall aerodynamic blockage accumulates rapidly as a fan/compressor approaches stall. The accumulation of low momentum endwall fluid is exacerbated by the incoming low momentum "boundary layer" fluid adjacent to the endwall, blade/endwall flow field interactions, shock/vortex interactions, shock/tip-leakage-jet interaction, radial migration of low momentum fluid to the endwall, etc. It was hypothesized that directly controlling the low momentum producing mechanisms would reduce the rate of accumulation of endwall blockage thereby improving rotor endwall performance and as a result increasing fan/compressor stall range.

A parametric investigation of various bleed and injection configurations was thus conducted using computational simulations including a model for simulating casing endwall bleed and injection. This investigation attempted to simulate the benefits of using endwall bleed to remove low momentum fluid near the endwall, thereby reducing endwall blockage. The benefits of injection were also simulated based on using high relative-total-pressure fluid to "energize" low momentum endwall fluid, thus reducing endwall blockage accumulation. The best candidate bleed and injection configurations were then simulated in a "coupled" fashion whereby the low momentum fluid bled off the casing endwall was recirculated upstream to supply fluid for the optimum injection configuration. The endwall treatment relied on the positive static pressure gradient across the rotor to self recirculate the low momentum fluid bled from the casing endwall to supply high relative total pressure fluid to the injection point to provide performance benefits from both bleed and injection. Directly controlling the fluid mechanisms producing endwall blockage resulted in a decrease in endwall blockage production and a consequent improvement in both stall range and efficiency.

Figure 4:
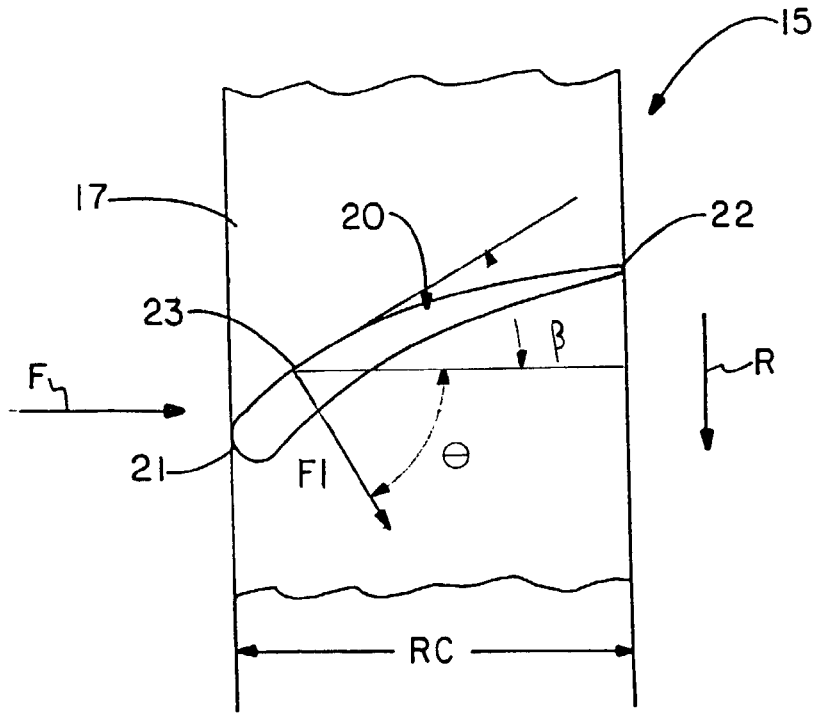
FIG. 4 is a schematic top elevational view of a blade shown in a free stream flow within an engine casing.

The investigation cases are summarized in Tables 1 and 2, and the description below. With reference to Table 2, fluid was bled from a number of positions relative to the chord length RC of the rotor blade 20 (FIG. 4). Table 2 describes these positions in terms of a percentage of the chord length RC ranging from about −20% to about 115%. These bleed cases related to a number of blockages B including boundary layer fluid, tip gap leakage, jet blockage, blockage aft of the leakage jet, and casing exit blockage. In the boundary layer case, injection occurred within a range of −20% of the chord length RC and −10% of the chord length RC. A percentage of the choke flow ($M_C$) of the free stream flow F was bled from the free stream flow F. As will be understood by one of ordinary skill, the choke flow ($M_C$) is the flow rate that for a constant rotor wheel speed cannot be increased by further reductions of downstream pressure. Overall, the bleed flow rate was from about −0.1% to about 1.5% of the choke mass flow $M_C$. In the boundary layer case, 1.3% of the choke mass flow rate $M_C$ was removed, resulting in a 26% increase in the stall range. For the tip gap leakage jet blockage cases, the inlet was positioned within the range of about 40% to about 70% of the chord length RC, and the bleed flow rates range from about 0.1% to about 2.3% of the choke mass flow $M_C$. In particular, they were 0.1%, 1.3% and 2.3% of the choke mass flow $M_C$. An increase in the stall range was observed for the first two cases, but not in the third case.

For the three blockages aft of the leakage jet cases, inlet was positioned from about 70% to about 80% of the chord length RC and the respective mass flows ranged from 1.3% to 3.5% of the choke mass flow $M_C$ with the particular bleed mass flow being 1.3%, 2.6% and 3.5%. An increase in the stall range was observed in each case and range from about 21% to about 55%, as shown in the Table.

Energizing cases were performed to simulate injection of an energizing fluid at locations ranging from about −15% to about 40% of the chord length RC. In a first case, injection to energize the casing inlet fluid was performed with injection at a location within the range of about −15% to about −10% of the chord length RC. The mass flow rate of the injected fluid FI was about 1.3% of the choke mass flow $M_C$ and the pitch wise angle of injection was at −30° relative to the axis of the rotor, resulting in a 28% decrease in the stall range. Two cases were performed to energize tip gap leakage fluid with the injection outlet located in the range of about 30% to about 40% of the rotor chord length RC. The mass flow rate of the injected fluid FI was about 1.3% of the choke mass flow $M_C$ in each case and the pitch wise angle of injection was −30° in the first case and −90° in the second case, resulting in respective increased in the stall range of 38% and 6%.

The final three cases in Table 2 relate to coupling the injection and bleed cases implementing an inlet to bleed fluid and an outlet to inject fluid. In the example cases, inlets adapted to bleed fluid in each of the three cases were located within the range of about 105% to about 115% of the chord length RC and outlets adapted to inject fluid were located in the range of about 30% to about 40% of the chord length, such that the outlets are located upstream of the inlets. In the first case, relating to bleed, bleeding of low momentum fluid, and injected mass flow rate of about 1.2% of the choke mass flow $M_c$ was injected at a pitch wise angle of −30° resulting in 43% increase in the stall range. The remaining two cases injected fluid FI of about 1.9% of the choke mass flow $M_C$ with the first case being injected at a pitch wise angle alpha −60°° and the second case having a pitch wise angle alpha of −30°. These two cases respectively produced stall range increases of about 64% and about 60%.

TABLE 1

| Parametric Bleed, Injection, and Coupled Cases |
|---|
| BLEED CASE |
| Bleed off incoming low momentum fluid along casing endwall |
| Bleed off low momentum fluid in blade suction side/endwall corner |
| Bleed off leading edge vortex fluid |
| Bleed off low momentum fluid spilling across tip leakage gap |
| Bleed off low momentum fluid aft of blade trailing edge |
| INJECTION CASES |
| Energize incoming low momentum fluid along casing endwall |
| Energize low momentum fluid in blade suction side/endwall corner |
| Energize leading edge vortex |
| Energize low momentum fluid spilling across tip leakage gap |
| COUPLED BLEED AND INJECTION |
| Optimum bleed and injection configurations |

Figure 1A:
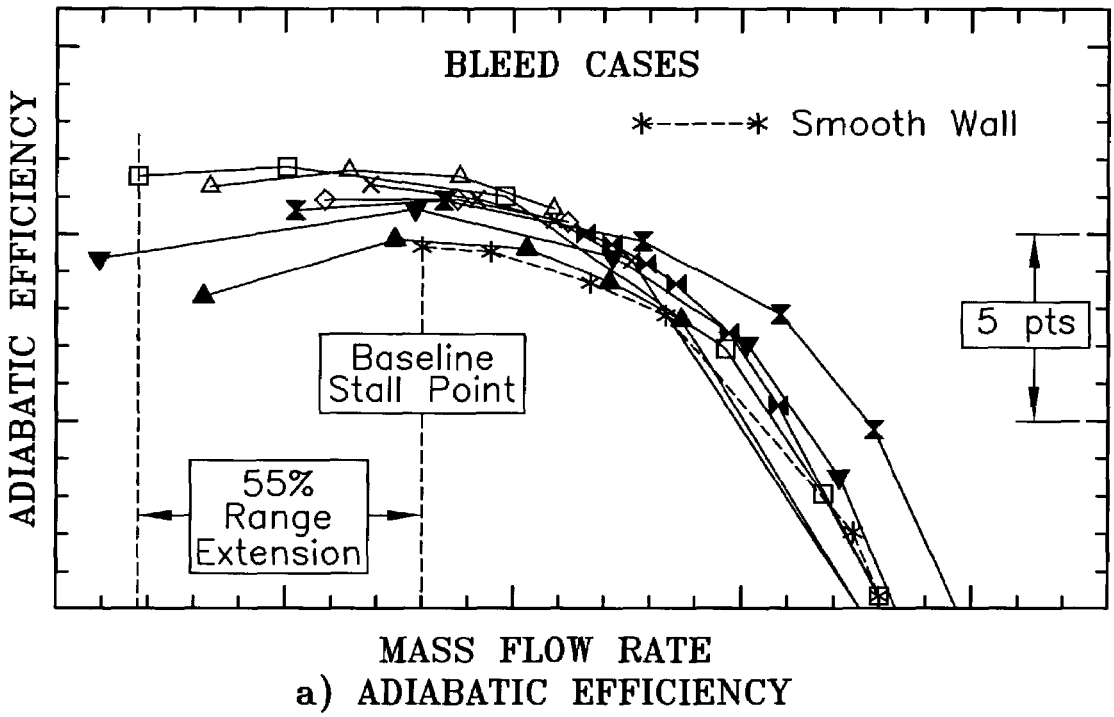
FIG. 1A is a representative graph of casing bleed parametric cases applied to a low speed fan rotor depicting adiabatic efficiency for a given mass flow rate.
Figure 1B:
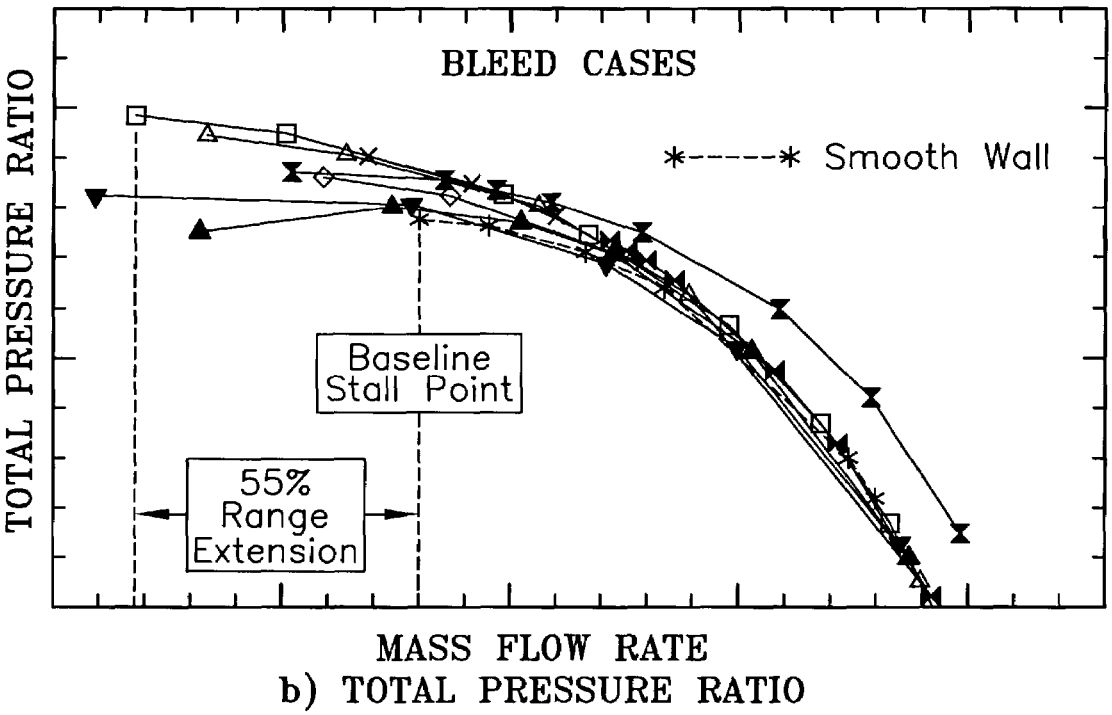
FIG. 1B is a representative graph of casing bleed parametric cases applied to a low speed fan rotor depicting total pressure for a given mass flow rate.

FIG. 1 shows a comparison of the results of a parametric study of casing bleed. Each of the bleed cases were selected to bleed off endwall fluid identified from CFD simulations to be a potential contributor to endwall blockage production. Both mass averaged total pressure ratio and adiabatic efficiency are presented in FIG. 1. As evident from FIG. 1, casing endwall bleed is in most cases beneficial, but in some instances can be detrimental to overall performance. The performance parameters in FIG. 1 are based on a control volume analysis of the rotor and therefore take into account the energy of the fluid entering and leaving the control volume, including that which crosses the casing boundary. As such, no credit to performance is obtained from bleeding off low momentum fluid unless the gains are accrued from increased aerodynamic performance.

Figure 2A:
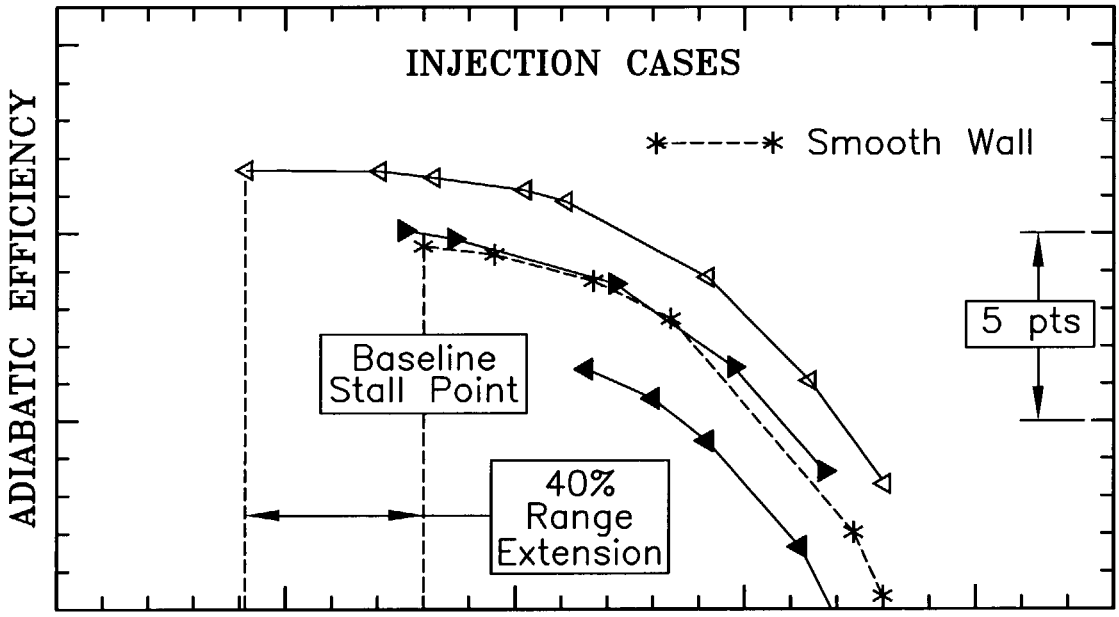
FIG. 2A is representative graph of casing injection parametric examples cases applied to a low speed fan rotor depicting adiabatic efficiency for a given mass flow rate.
Figure 2B:
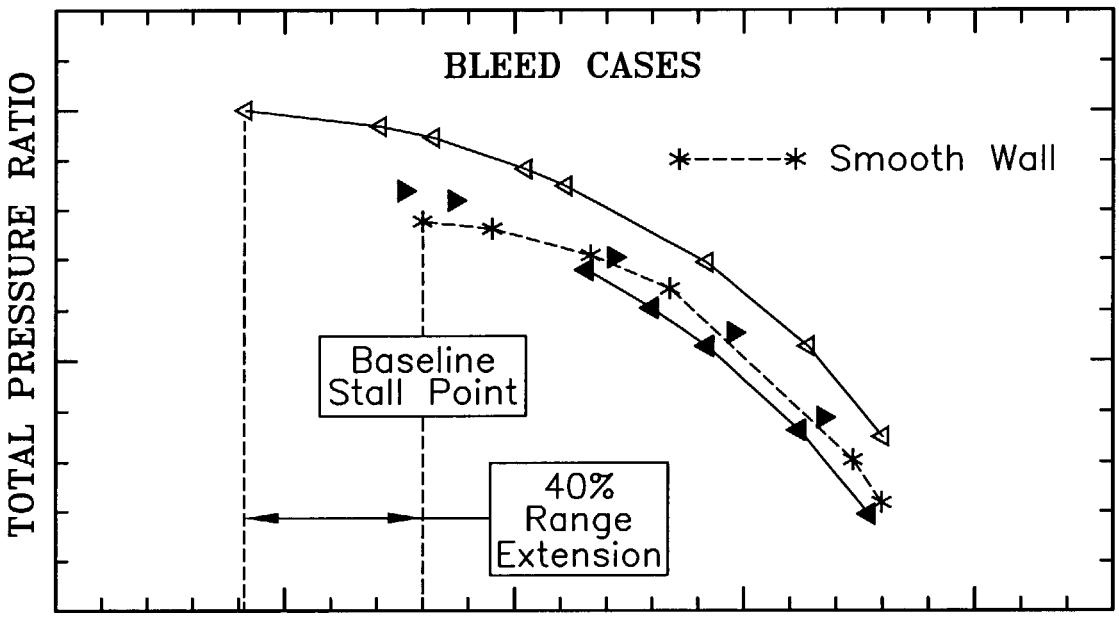
FIG. 2B is representative graph of casing injection parametric examples cases applied to a low speed fan rotor depicting total pressure ratio for a given mass flow rate.

FIG. 2 shows a comparison of the results of the parametric study of endwall injection. Each of the injection cases was selected to effect control over a specific endwall fluid mechanism identified from CFD simulations to be a potential contributor to endwall blockage production. It is evident from FIG. 2 that casing mass injection can hurt or help overall performance, and in one example case has the potential for increasing adiabatic efficiency. The injection case example, which produced an increase in adiabatic efficiency, and stall range, is the case that impacted the most significant blockage producing mechanism identified from the CFD simulations, the tip leakage vortex. The coupled bleed and injection configuration exhibited a significant reduction in endwall blockage results, which improves rotor efficiency and increases stall range.

Based on the results of these independent parametric studies of casing bleed and injection additional simulations were performed which coupled the best bleed and injection cases to model a self-recirculating endwall treatment. In the model, the injected and bled mass flow rates ($m_i$ and $m_b$) were to be the same, and the total temperature of the injected fluid ($T_{t,i}$) was that of the mass averaged total temperature of the fluid bled from the rotor flow field ($T_{t,b}$) The total pressure of the injected fluid ($P_{t,i}$) was derived from the average static pressure of the bled fluid ($P_b$) plus the mass averaged dynamic pressure of the bled fluid ($\frac{1}{2}\gamma P_b M_{abs,b}2$) with an assumed loss (ω) in dynamic pressure due to bleed cavity inlet losses and loss incurred within the re-circulated endwall treatment flow path.

At the completion of each flip of the APNASA simulations the bleed and injection boundary conditions were updated. This was accomplished with an external FORTRAN program which mass averaged the flow conditions over the bleed and injection ports and then imposed the endwall treatment model and the prescribed injection and bleed port conditions as described above. The simulation converged when both the APNASA convergence criteria were met and the bleed and injection boundary condition parameters did not change from flip to flip.

Figure 6A:
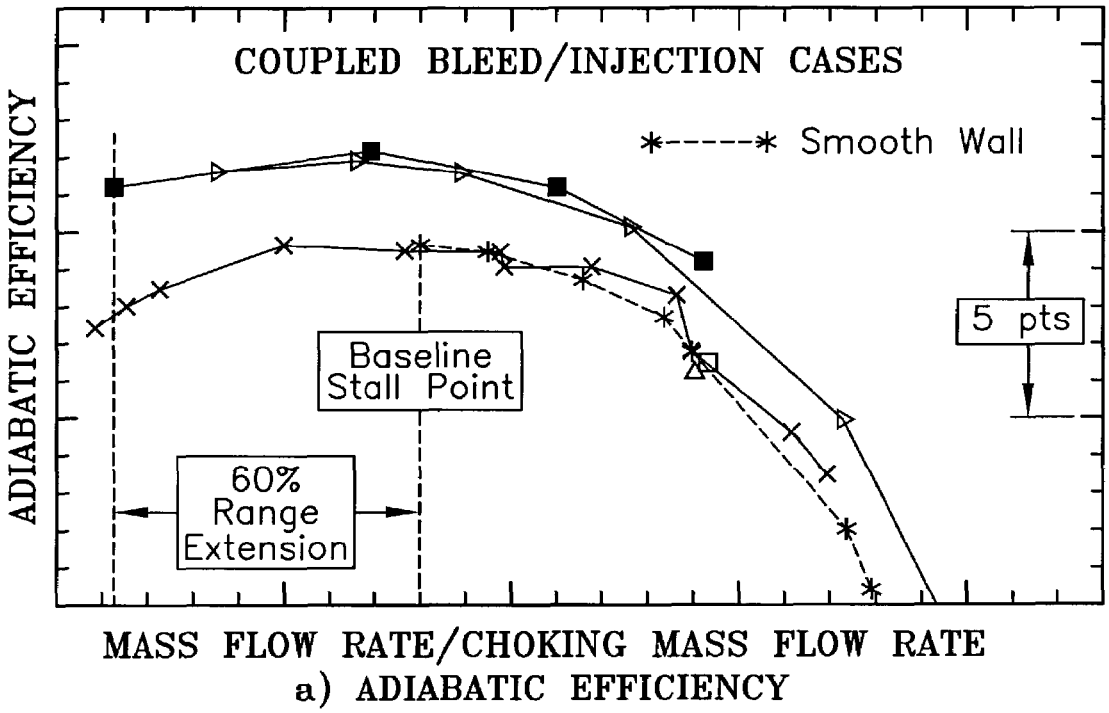
FIG. 6A is a representative graph of coupled bleed/injection cases applied to low speed fan cases depicting adiabatic efficiency as a function of mass flow rate.
Figure 6B:
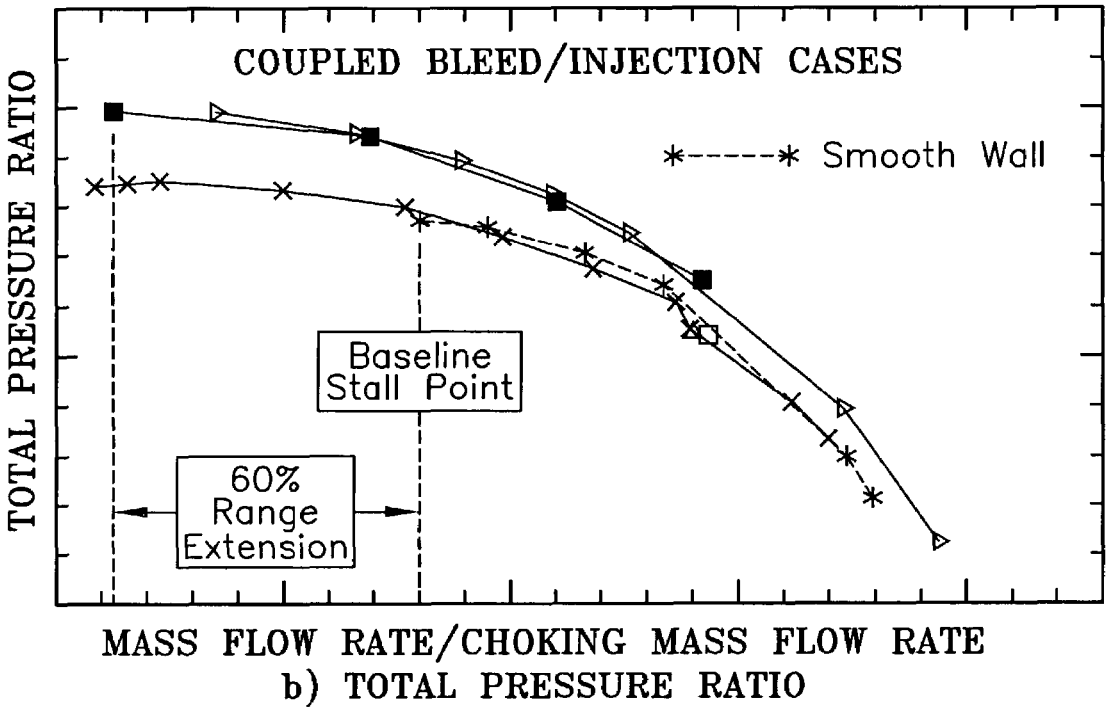
FIG. 6B is a representative graph of coupled bleed/injection cases applied to low speed fan cases depicting total pressure ratio as a function of mass flow rate.
Figure 7:
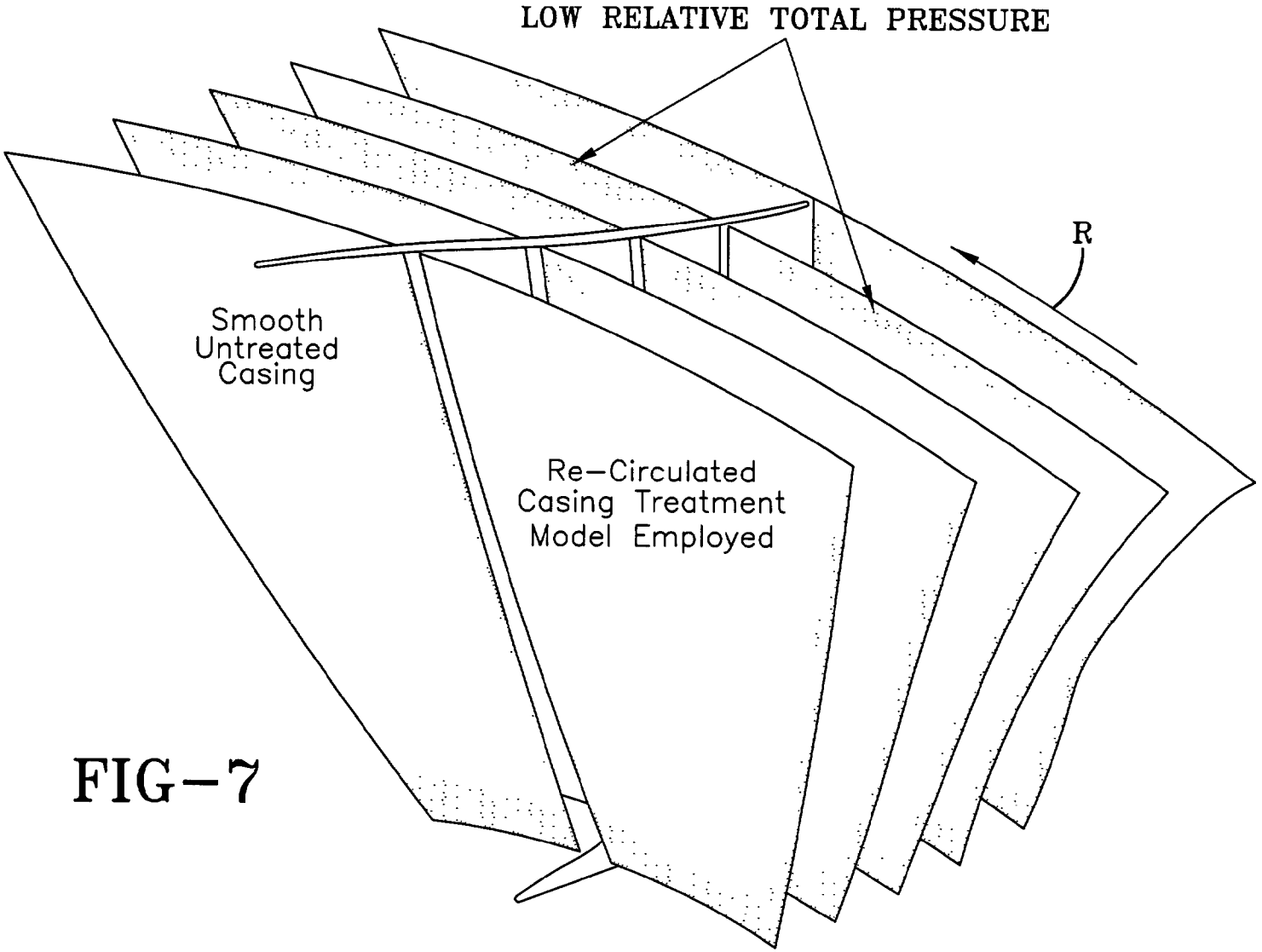
FIG. 7 is a graphic depiction comparing relative total pressure contours for smooth and treated casing endwalls for a low speed fan rotor.

As evidenced by the results of the coupled bleed and injection endwall treatment model, shown in FIG. 6, not only does the self-recirculating endwall treatment concept provide increased range it also has potential for increasing total pressure rise capability of the rotor and adiabatic efficiency. As indicated by the differences in the self-recirculated endwall treatment results, presented in FIG. 6, implementation is important for maximum benefit. However, all cases presented provided range increase with no decrement in efficiency from the smooth untreated case. FIG. 7 shows a comparison of relative total pressure contours between the self-recirculated endwall treatment case and the smooth untreated case. As shown in FIG. 7 the extent of low relative total pressure accumulated near the casing endwall is significantly less for the case employing the self-recirculating endwall treatment model relative to the smooth untreated case.

The low tip speed fan parametric study provided a fundamental understanding of the fluid mechanisms important to control to obtain improvement in stall range without a decrement in efficiency. A concept for implementing a self-recirculating endwall treatment was formulated and demonstrated by the results of the simulations with the coupled bleed and injection model as applied to this low speed tip-critical fan. To assess how generic this self-recirculated endwall treatment concept is it was applied to a very efficient transonic fan rotor, NASA's Rotor 67. The peak adiabatic efficiency of Rotor 67 has been reported at 92%.

Figure 8:
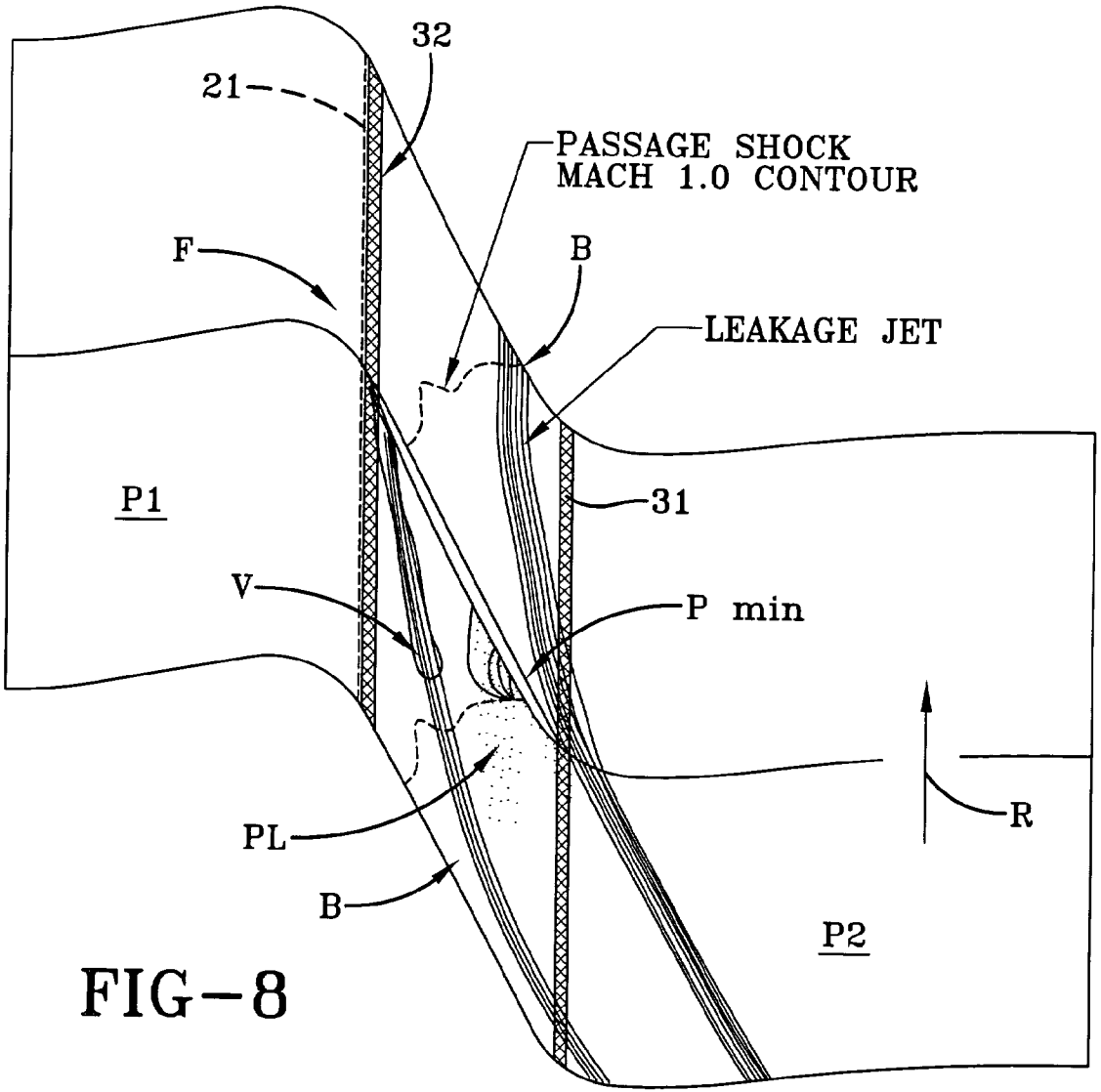
FIG. 8 is a representative graph depicting relative total pressure surface contours at the tip section of a transonic fan rotor-identifying blockage producing mechanisms.
Figure 9A:
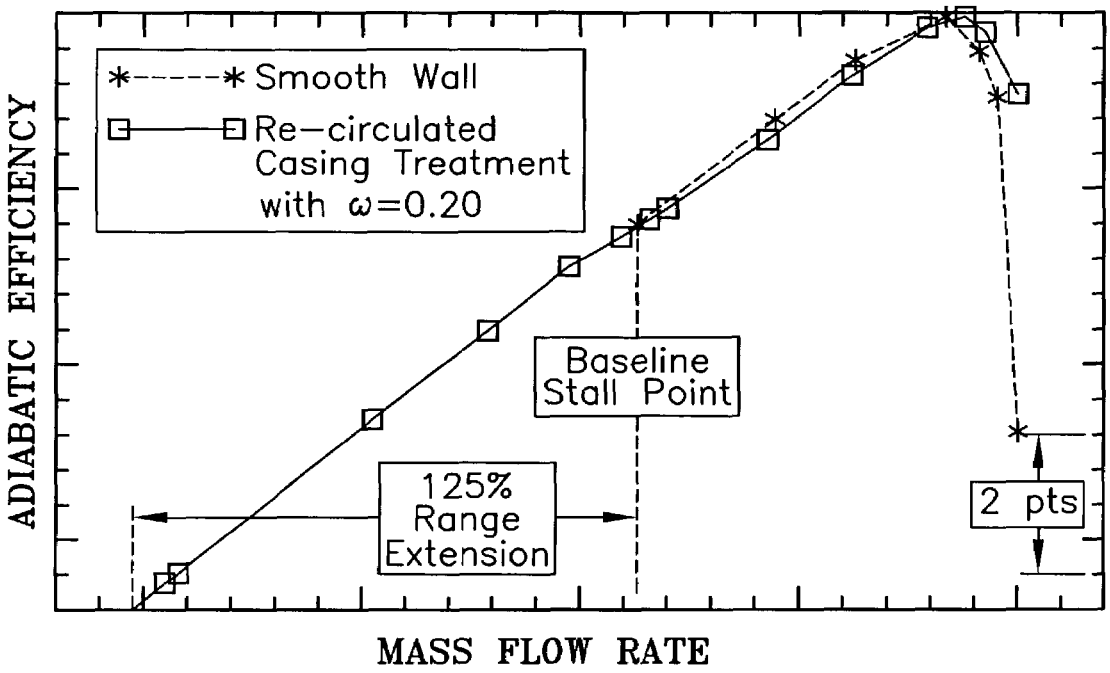
FIG. 9A is a representative graph of adiabatic efficiency as a function of mass flow rate for an example recirculated endwall treatment applied to a transonic fan rotor without inlet distortion.
Figure 9B:
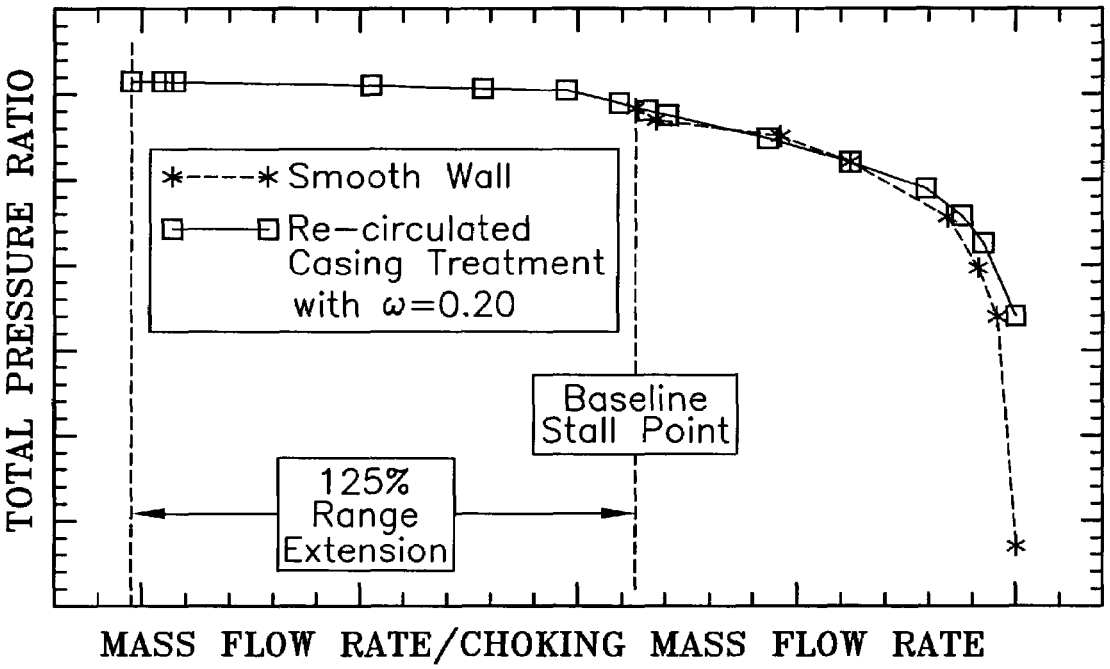
FIG. 9B is a representative graph of total pressure ratio as a function of mass flow rate for an example recirculated endwall treatment applied to a transonic fan rotor without inlet distortion.

The results of APNASA simulations of Rotor 67 without endwall treatment were used to guide the configuration of the self-recirculating endwall treatment concept to be employed for Rotor 67. The fluid mechanism identified from the simulations to be most responsible for producing endwall blockage for Rotor 67(FIG. 8) was similar to the mechanism identified for the low speed fan rotor (FIG. 5). It was noted that a passage shock was present and terminated on the suction surface in the region of low relative total pressure fluid. The injection port was located near the blade leading edge to effect control over the leading edge vortex and tip section loading with the expectation that, such location, would beneficially impact the extent of low relative total pressure leaking across the blade tip gap. The results shown in FIG. 9 show the self-recirculated endwall treatment concept employed does provide benefits to Rotor 67 performance. Significant stall range increase was predicted with no decrement in rotor efficiency.

Figure 10:
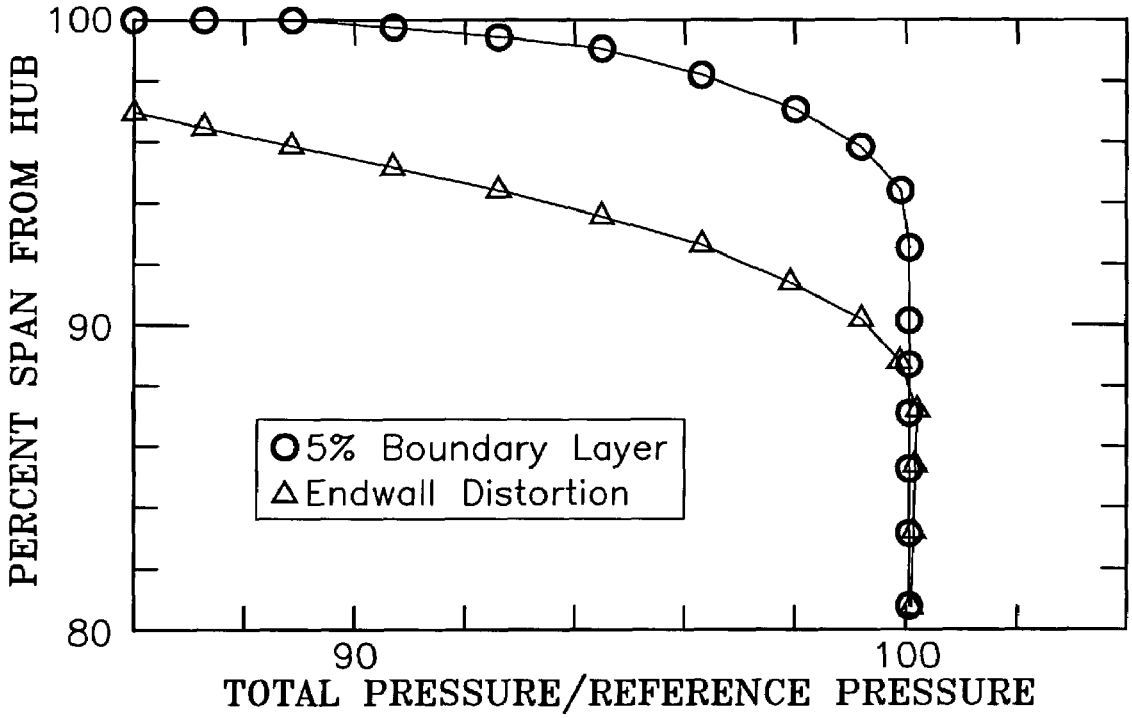
FIG. 10 is a representative graph representing distorted and nondistorted inlet total pressure profiles applied to a transonic fan rotor showing total pressure/reference pressure in terms of the percentage span from the hub.
Figure 11A:
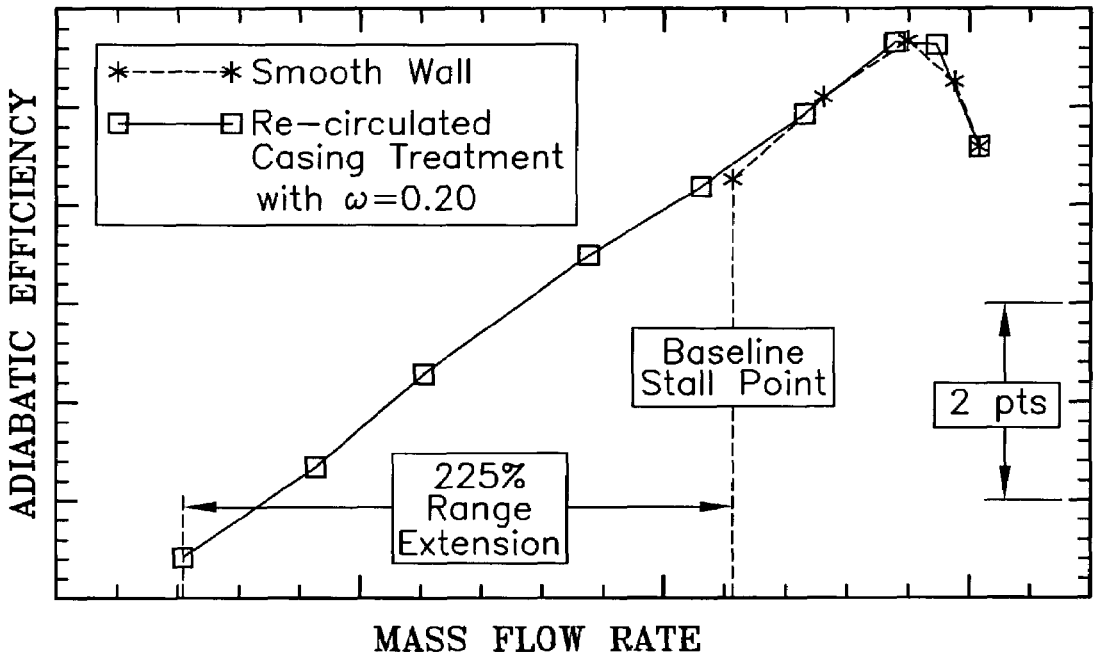
FIG. 11A is a representative graph depicting adiabatic efficiency as a function of mass flow rate for a recirculated endwall treatment applied to a transonic fan rotor with inlet distortion.
Figure 11B:
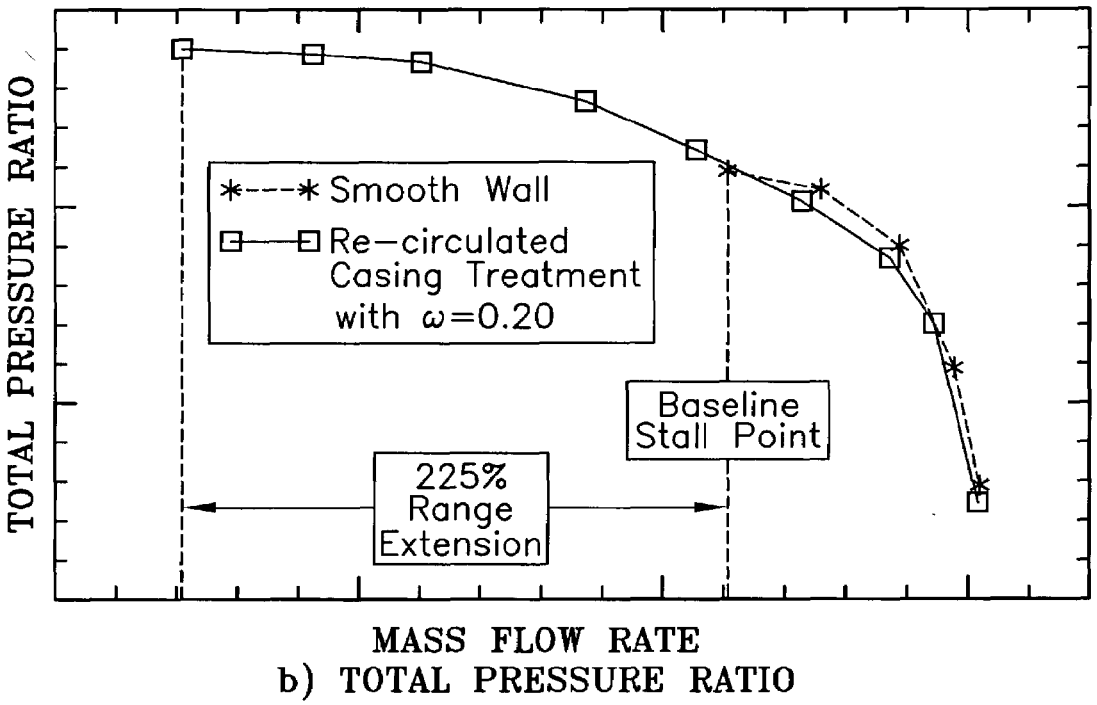
FIG. 11B is a representative graph depicting total pressure ratio as a function of mass flow rate for a recirculated endwall treatment applied to a transonic fan rotor with inlet distortion.

Since Rotor 67 already has good stall range capability, and as a test of the applicability of the concept to effectively extend stall range for a distorted inlet condition, simulations of Rotor 67 with and without inlet distortion were conducted. The distorted and undistorted inlet profiles are shown in FIG. 10. The distortion was only applied to the casing endwall to reduce stall range relative to the undistorted case. As shown in FIG. 11, an example endwall treatment, according to the concepts of the present invention also provides considerable benefit in extending the stall range when there is an inlet distortion. Although neither the distorted or undistorted cases showed improved efficiency as a result of the self-recirculated endwall treatment they both show significant range increase without the usual decrement in efficiency relative to the base line untreated efficiency.

In light of the foregoing, it should thus be evident that the process of the present invention, providing a self-recirculating endwall suction and reinjection method for fan/compressor stabilization and efficiency improvement, substantially improves the art. While, in accordance with the patent statutes, only the preferred embodiments of the present invention have been described in detail hereinabove, the present invention is not to be limited thereto or thereby. Rather, the scope of the invention shall include all modifications and variations that fall within the scope of the attached claims.

What is claimed is:

1. An endwall treatment method for a gas turbine engine comprising:

providing at least one treatment having an inlet and an outlet in fluid communication with each other;

injecting fluid into a free stream flow to alleviate a blockage within the free stream flow;

wherein injection of the fluid occurs near the source of the blockage; and wherein the mass flow rate of the injected fluid is commensurate with a mass flow deficit created by the blockage.

2. An endwall treatment method for a gas turbine engine comprising:

providing at least one treatment having an inlet and an outlet in fluid communication with each other, wherein said treatment covers less than 100% of the circumference of the gas turbine engine leaving an untreated space, wherein at least about 50% of the circumference is untreated space; injecting fluid into a free stream flow to alleviate a blockage within the free stream flow; wherein the fluid is injected at a yaw angle adapted to align the injected fluid with a rotor blade suction surface of the gas turbine in accounts for the rotor's influence on the injected flow; and wherein injection of the fluid occurs near of the blockage; and wherein the mass flow rate of the injected fluid is commensurate with a mass flow deficit created by the blockage.

3. An endwall treatment method for a gas turbine engine comprising:

providing at least one treatment having an inlet and an outlet in fluid communication with each other;

injecting fluid into a free stream flow to alleviate a blockage within the free stream flow;

wherein injection of the fluid occurs near the source of the blockage; and wherein the injected fluid is injected at a velocity substantially equal to a velocity deficit caused by the blockage.

4. An endwall treatment method for a gas turbine engine comprising:

providing at least one treatment having an inlet and an outlet in fluid communication with each other, wherein said treatment covers less than 100% of the circumference of the gas turbine engine leaving an untreated space, wherein at least about 50% of the circumference is untreated space;

injecting fluid into a free stream flow to alleviate a blockage within the free stream flow; and wherein injection of the fluid occurs near the source of the blockage, and wherein the injected fluid is injected at a velocity substantially equal to a velocity deficit caused by the blockage.

5. An endwall treatment method for a gas turbine engine comprising:

providing at least one treatment having an inlet and an outlet in fluid communication with each other;

injecting fluid into a free stream flow to alleviate a blockage within the free stream flow;

wherein injection of the fluid occurs near the source of the blockage; and sizing the inlet such that the area of the inlet accommodates the mass flow rate of the injected fluid and prevents choking of the injected fluid.

6. An endwall treatment method for a gas turbine engine comprising:

providing at least one treatment having an inlet and an outlet in fluid communication with each other, wherein said treatment covers less than 100% of the circumference of the gas turbine engine leaving an untreated space, wherein at least about 50% of the circumference is untreated space;

injecting fluid into a free stream flow to alleviate a blockage within the free stream flow; and wherein injection of the fluid occurs near the source of the blockage, wherein the fluid is inject at a yaw angle adapted to align the injected fluid with a rotor blade suction surface of the gas turbine and accounts for the rotor's influence on the injected flow; and sizing the injection port such that the area of injection accommodates the mass flow rate of the injected fluid and prevents choking of the injected fluid.

7. An endwall treatment for a gas turbine engine having at least one rotor blade extending from a rotatable hub and a casing circumferentially surrounding the rotor and the hub, the endwall treatment comprising:

an inlet formed in an endwall of the gas turbine engine adapted to ingest fluid from a region of a higher-pressure fluid;

an outlet formed in the endwall and located in a region of lower pressure than said inlet;

wherein said inlet and said outlet are in a fluid communication with each other, said outlet being adapted to inject said fluid from said inlet in said region of lower pressure; and wherein said inlet has an inlet area and said outlet has an outlet area, said outlet area being smaller than said inlet area.

8. An endwall treatment for a gas turbine engine having at least one rotor blade extending from a rotatable hub and a casing circumferentially surrounding the rotor and the hub, the endwall treatment comprising:

an inlet formed in an endwall of the gas turbine engine adapted to ingest fluid from a region of a higher-pressure fluid;

an outlet formed in the endwall and located in a region of lower pressure than said inlet;

wherein said inlet and said outlet are in a fluid communication with each other, said outlet being adapted to inject said fluid from said inlet in said region of lower pressure; and wherein said casing defines a flow path between said inlet and said outlet and wherein said flow path converges from the inlet toward the outlet.

9. A method of treating a blockage within a free stream flow through a gas turbine, the gas turbine having a rotor rotatable about an axis and having at least one blade, the method comprising:

providing plural treatments, each treatment having an inlet and an outlet in fluid communication with each other;

providing an untreated space between each said treatments;

non-uniformly spacing said treatments relative to each other, by the untreated space, and bleeding a portion of the free stream flow through said inlet and recirculating the portion through said outlet located upstream of said inlet within the free stream flow to energize the blockage.

10. The method of claim 9, further comprising offsetting said outlet relative to said inlet in a direction of the rotation of the rotor.

11. The method of claim 9, further comprising injecting said portion of the free stream flow at an angle that accounts for the rotor's influence on the injected flow.

12. An endwall treatment for relieving a blockage near a rotor, the rotor being rotatable about an axis and having at least one blade, the blade having a chord length in an axial direction, the endwall treatment comprising:

an outlet adapted to inject fluid to alleviate the blockage; where said outlet is located at an axial position of about −15% to about −40% of the chord length wherein 0% represents a leading edge of the chord; and wherein said outlet injects fluid at an injected mass flow rate of about 1.3% of a choke mass flow through the rotor.

13. The endwall treatment of claim 12, wherein said outlet injects fluid at a pitch wise angle of about −30° to about −90° relative to the axis.

14. An endwall treatment used to relive a blockage near a rotor in a gas turbine, the rotor being rotatable about an axis and having at least one blade, the blade having a chord length, the endwall treatment comprising:

an inlet adapted to bleed fluid from the blockage, where the inlet is axially located relative to the blade in a position within a range from about −20% to about 115% of the chord length, wherein 0% represents a leading edge of the chord, wherein the fluid has a choke mass flow rate and wherein said inlet bleeds a percentage of the choke mass flow rate from about 0.1% to about 3.5%.

15. The endwall treatment of claim 14, where the position of the inlet is within a range from about −20% to about −10% of the chord length.

16. The endwall treatment of claim 14, wherein the position of the inlet is located within a range from about 30% to about 80% of the chord length.

17. The endwall treatment of claim 14, wherein the inlet is located in a position within a range of about 40% to about 80% of the chord length.

18. The endwall treatment of claim 17, wherein the position of the inlet is located within a range of about 40% to about 70% of the chord length.

19. The endwall treatment of claim 17, wherein the inlet is located at a position within a range of about 70% to about 80% of the chord length.

20. The endwall treatment of claim 14, wherein the inlet is located at a position within a range of about 105% to about 115% of the chord length.

21. The endwall treatment of claim 14, further comprising an outlet adapted to inject fluid to alleviate the blockage, where the outlet is located at a position within a range of about −15% to about −115% of the chord length.

22. The endwall treatment of claim 21, wherein said outlet is located at a position within a range of about −15% to about −10%.

23. The endwall treatment of claim 21, wherein said outlet is located at a position within a range of about 30% to about 40% of the chord length.

24. The endwall treatment of clam 21, wherein said outlet is located in a position within a range of about 105% to about 115% of the chord length.

25. The endwall treatment of claim 21, wherein said outlet injects fluid at an injected mass flow rate within a range of about 1% to about 2% of the choke mass flow rate.

26. The endwall treatment of claim 25, wherein said injected mass flow rate is about 1.2% to about 1.9% of the choke mass flow rate.

27. The endwall treatment of claim 21, wherein said outlet injects fluid at a pitch wise angle relative to the axis of about −30° to about −90°.

28. The endwall treatment of claim 27, wherein said pitch wise angle is about −30° to about −60° relative to the axis of the rotor.

29. The endwall treatment of claim 28, wherein said injected mass flow rate is about 1.9% of a choke mass flow rate through the rotor.

30. An endwall treatment for treating a blockage within a gas turbine having at least one rotor blade extending from a rotatable hub, the hub being located in a free stream flow wherein a blockage is located in the free stream flow adjacent the rotor blade, the endwall treatment comprising:

an inlet adapted to bleed higher-pressure fluid from the free stream;

an outlet fluidly connected to the inlet, wherein said outlet is adapted to deliver the higher pressure fluid from said inlet to energize the free stream flow near a source of the blockage; and wherein said outlet is oriented to direct said high pressure fluid at a suction surface of the blade wherein said outlet is oriented such that in the rotor's frame of reference said higher pressure fluid is injected in substantial alignment with said suction surface.

31. The endwall treatment of claim 30, wherein said inlet defines an inlet area, said inlet area is sized to prevent a flow of ingested fluid from choking at said inlet.

32. The endwall treatment of claim 31, wherein said inlet area is proportional to a mass of the flow, a density of the flow and a velocity of the flow.

33. The endwall treatment of claim 32, wherein said inlet area equals the mass of the flow divided by a product of the density and velocity of said flow.

34. The endwall treatment of claim 30, wherein said outlet is adapted to inject the fluid near a leading edge vortex.

35. The endwall treatment of claim 30, wherein said inlet is located adjacent the trailing edge of said rotor.

36. The endwall treatment of claim 30, wherein said inlet has an inlet area and said outlet has an outlet area, said outlet area being smaller than said inlet area.

37. The endwall treatment of claim 30, wherein said casing defines a flow path between said inlet and said outlet.

38. The endwall treatment of claim 37, wherein said flow path converges from the inlet toward the outlet.

39. The endwall treatment of claim 38, wherein said flow path converges in a non-linear fashion.

40. The endwall treatment of claim 39, wherein said flow path converges circumferentially from said inlet to said outlet.

41. The endwall treatment of claim 30, wherein said outlet is adapted to inject an energizing flow near a source of a blockage.

* * * * *